United States Patent [19]

Smith

[11] 4,360,940

[45] Nov. 30, 1982

[54] CORNER BRUSH

[76] Inventor: Louise W. Smith, 3705 N. Queensgrove Cir., Virginia Beach, Va. 23452

[21] Appl. No.: 249,917

[22] Filed: Apr. 1, 1981

[51] Int. Cl.[3] ..... A46B 9/02

[52] U.S. Cl. ..... 15/160

[58] Field of Search ..... 15/159 R, 160, 176, 15/145

[56] References Cited

U.S. PATENT DOCUMENTS

| | | | |
|---|---|---|---|
| 313,776 | 3/1885 | Sebring | 15/160 |
| 608,365 | 8/1898 | Goehring | 15/160 |
| 817,117 | 4/1906 | Isaacs | 15/160 X |
| 1,176,996 | 3/1916 | Templeman | 15/160 X |
| 3,503,089 | 3/1970 | Coneway | 15/160 |

FOREIGN PATENT DOCUMENTS

| | | | |
|---|---|---|---|
| 57944 | 12/1911 | Switzerland | 15/160 |

*Primary Examiner*—Peter Feldman

[57] ABSTRACT

A corner brush assembly for cleaning corners including a flat brush head having a substantially rectangular body section integral with a horizontally tapered nose portion extending forwardly away from the body section. A handle is fastened in a predetermined angular relationship to the rear portion of the rectangular body section of the brush head. An appropriate number of bristles composed of a material suitable for a particular range of uses are imbedded in the body section so as to extend perpendicularly to the body. An appropriate number of bristles are embedded in the nose portion of the brush head at forwardly extending positions so that the forward angles relative to the brush head gradually decrease toward the forward nose and causing the bristles to extend further forward of the head as they are embedded toward the nose end. These bristles increase in length as the forward installation toward the nose end progresses. This is necessary to maintain the free ends of the bristles in a common plane across the brush head. The bristles are also cut to form a centerline wedge tapering up and outwardly from the brush center to the sides of the brush head.

2 Claims, 4 Drawing Figures

CORNER BRUSH

BACKGROUND OF THE INVENTION

This invention relates to the brushing or cleaning of corner areas and other inaccessible surfaces. More specifically this invention pertains to a corner brush having structural cleaning feature not heretofore disclosed in the brushing and cleaning art. The prior art consists of brushes of various kinds, shapes and sizes, some of which include tapered surfaces. These known structures, some of which are tapered, do not permit the cleaning features of the subject corner brush invention.

SUMMARY OF THE INVENTION AND OBJECTS

The invention is a corner brush including a brush head having a tapered nose section with a plurality of nylon or other appropriate bristles having a predetermined stiffness secured on one side and an angularly extending handle rigidly secured thereto on the other side. A rearward portion of the bristles are secured on a position normal to the brush head while those forwardly toward the tapered nose are positioned angularly to and extend substantially beyond the nose of the brush head. The bristles are also collectively tapered inwardly from each longitudinal side of the brush head toward the center forming a wedge with an apex running longitudinally and centerally of the brush head. The angularly positioned bristles extending beyond the nose permit cleaning of normally inaccessible areas such as corners formed by three intersecting wall surfaces while the wedge shape permits cleaning of corner areas formed by two intersecting wall surfaces.

Accordingly it is an object of this invention to provide a corner brush incorporating structural features permitting cleaning of normally inaccessible areas.

It is an object of this invention to provide a corner brush having bristles extending beyond its forward nose for cleaning corner areas.

It is another object of this invention to provide a corner brush having bristles collectively in the shape of a wedge for cleaning corner areas.

A further object of this invention is the provision of a corner brush that has a unique corner area cleaning form and can readily accommodate handles of varying length depending upon a particular intended use.

It is a further object of this invention to provide a corner brush having a tapered nose section formed on the brush head for ease of insertion into corner areas.

Other further objects of this invention will become more readily apparent as the disclosed subject matter is more fully understood from the following disclosure.

It is obvious that the brush head of the subject invention can be of various sizes and can utilize bristles composed of any suitable materials and be of any predetermined stiffness depending upon specific contemplated cleaning functions of the corner brush assembly. Further it is apparent the bristles can be secured to the brush head by any known suitable method. Likewise, the handle can be of any length and configuration and be rigidly secured to the brush head by any known suitable method.

DETAILED DESCRIPTION OF A PREFERRED EMBODIMENT

Figures 1, 2, 3, 4:
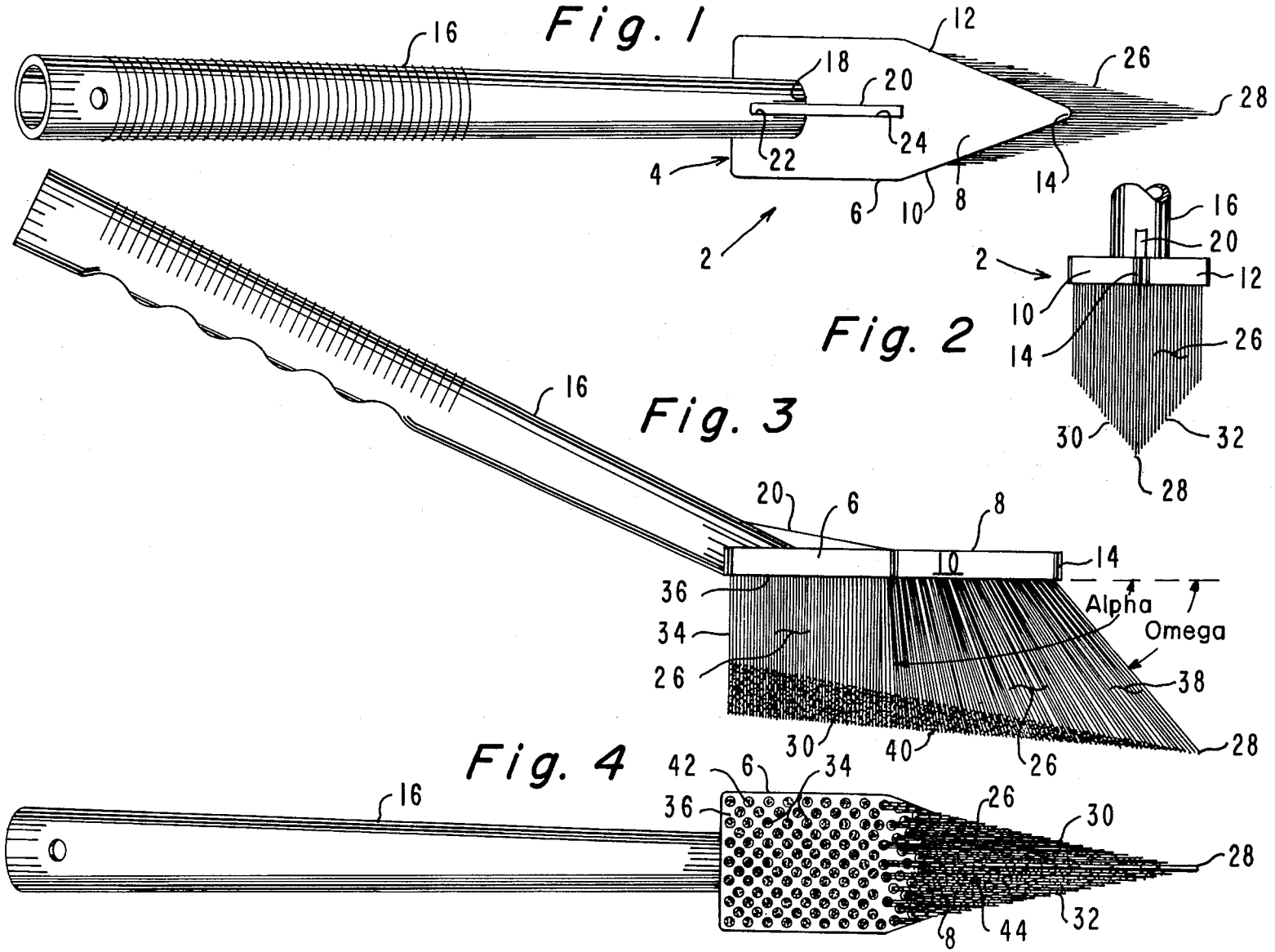
FIG. 1 is a top plan view showing a handle rigidly secured to the brush head with its tapered nose section extending forwardly away from the handle with the brush bristles extending substantially beyond the tapered nose.
FIG. 2 is an end view, looking toward the front of the brush assembly, illustrating the bristles forming a point beyond the tapered nose and being collectively tapered into a wedge form.
FIG. 3 is a side view showing the handle mounted in the rear portion of the brush head and specifically illustrating the respective bristle lengths to form a forward point and a longitudinal wedge.
FIG. 4 is a bottom view showing the mounting of the bristles in the brush head with those in the rear rectangular portion being normal to the brush head while those in the tapered nose section extend angularly forward relative to the brush head.

With initial reference to FIG. 1, a corner brush assembly 2 including a brush head 4 having a substantially rectangular rear body section 6 and an integral nose section 8 tapered forming angular surfaces 10 and 12. The nose section 8 has a rounded end surface 14 for a purpose to be later described. A handle 16 is secured into an angular aperture 18 in rear body section 6 and rigidly retained therein by a fastening key 20 which is placed into mating grooves 22 and 24 in the handle and body section respectively. It can also be seen in FIG. 1 that a portion of brush bristles 26 extend beyond the nose section 8 and terminate in a bristle point 28. With reference to FIG. 2, it can be seen that the brush bristles 26 collectively are cut forming tapered surfaces 30 and 32 in the form of a wedge.

Referring now to FIG. 3, the bristles 26 are secured to the brush head 4 in predetermined relationships. The bristles 34 secured to rear body section 6 are positioned perpendicular to the lower side 36 of the body section. The bristles 26, on the other hand, are secured to the nose section 8 in a particular angular relationship. The angle between the bristles 26 and surface 36 of the nose section progressively decreases as the bristles are placed further forward on the nose section as evidenced by angles Alpha to Omega. The bristles 38 at the forward end of the brush head necessarily are of a length longer than those in the rear body section 6. As shown in FIGS. 1, 2, and 3, the bristles do not extend laterally outside the plane of the brush. The forming of the tapered surfaces 30 and 32 create center line 40 of the bristle wedge.

As illustrated in FIG. 4 the bristles 26 can be secured to the brush head 4 by fastening them in a plurality of holes 42 and 44. The holes 42 are drilled normal to the surface 36 while the holes 44 are at predetermined angles in the range Alpha to Omega. This method of securing the bristles is a preferred form for purposes of illustration only as they may be secured by other means such as use of an epoxy resin.

In use the brush assembly can be manually placed with bristle point section 28 into any inaccessible area and readily cleaned. Since the bristles 38 are forward of the nose section 8 and the rounded end surface 14, the brush can be projected into such areas without damage to those areas. In fact careful handling will permit cleaning while preventing contact of surface 14 with the surfaces being cleaned. Also the centerline 40 of the wedge permits drawing the brush along a corner area for effective cleaning. It is obvious that these aforementioned structural features provide significant cleaning advantages in the brush art.

From the foregoing description of my invention in its preferred form it will be apparent that various materials can be used in the formation of the components and that the handle and bristles can be of numerous shapes and sizes without departing from the underlying principles of my invention.

It is also apparent my corner brush is particularly suitable for cleaning any hard to reach or inaccessible area as those in corners, behind mechanical devices and appliances. I do not desire to be limited in my protection to the specific details illustrated and described except as may be necessitated by the appended claims:

I claim:

1. A corner brush assembly including a flat brush head having a tapered nose section, a plurality of bristles having a predetermined stiffness secured to one side of said brush head, said bristles not extending laterally outside the plane of said head, a first rear portion of bristles extending perpendicular to the flat head, a second portion of said bristles being angularly positioned relative to said brush head so that they extend forwardly of said nose section a predetermined distance for brushing corner areas, said bristles collectively being cut in a taper forming a wedge, the centerline of which is substantially centered with said flat brush head so that the wedge can be used to brush corner areas and a handle having a predetermined length rigidly secured to said brush head so that said brush assembly can be used for brushing corner areas as desired.

2. A corner brush assembly including a flat brush head having a substantially rectangular rear body section and an integral tapered but rounded forward nose section, said flat brush head having an upper face and a lower face when disposed parallel to a surface to be cleaned, said lower face of said rectangular body section having a plurality of holes distributed over and perpendicular to said lower face, said lower face of said integral tapered nose section likewise having a plurality of holes distributed thereover but said holes being angularly positioned so that an inclusive angle between centerlines of the holes and said lower face progressively decreases as the holes are positioned toward the forward end of said nose section, a plurality of bristles having a predetermined stiffness secured in each of said holes, said bristles not extending laterally outside the plane of said has said bristles in said nose section being longer in length than those in said body section so that those at the tapered end of said nose section extend a substantial distance forwardly of said flat brush head and terminate in a point permitting the brushing of corner areas formed by three intersecting wall surfaces, said bristles in said brush head being collectively tapered forming a wedge, the centerline of said wedge being centerally positioned relative to said brush head defining a line in said bristles permitting the brushing of corner areas formed by two intersecting wall surfaces, an angular hole extending rearwardly in the upper face of said rectangular rear body section, and a handle of a predetermined length secured and rigidly supported in said hole so that the corner brush assembly can be used for predetermined cleaning purposes.

* * * * *